US005502546A

United States Patent [19]

Muto

[11] Patent Number: 5,502,546

[45] Date of Patent: Mar. 26, 1996

[54] IMAGE FIXING HEATER HAVING STANDBY TEMPERATURE CONTROL

[75] Inventor: Kiyoshi Muto, Yokkaichi, Japan

[73] Assignee: Brother Kogyo Kabushiki Kaisha, Aichi, Japan

[21] Appl. No.: 323,725

[22] Filed: Oct. 18, 1994

[30] Foreign Application Priority Data

Oct. 20, 1993 [JP] Japan ..... 5-262111

[51] Int. Cl.[6] ..... G03G 13/20; G03G 15/20

[52] U.S. Cl. ..... 355/208; 355/285

[58] Field of Search ..... 355/285, 289, 355/290, 208, 282

[56] References Cited

U.S. PATENT DOCUMENTS 4,627,714 12/1986 Nozaki ..... 355/285
4,671,643 6/1987 Shigemura et al. ..... 355/282
4,868,368 9/1989 Araki ..... 219/216
5,241,349 8/1993 Nagasaka ..... 355/285
5,321,478 6/1994 Nakamura et al. ..... 355/285

*Primary Examiner*—Nestor R. Ramirez
*Attorney, Agent, or Firm*—Oliff & Berridge

[57] ABSTRACT

An electrophotographic image forming system wherein a visible image is generated on a recording medium in response to a print start command, and the visible image is fixed on the recording medium by heat generated by a heater. The temperature of the heater is controlled by a controller such that the detected temperature of the heater is held at an image fixing temperature when the system is in a printing operation, at a high stand-by level lower than the image fixing level when the system is in a first stand-by state without the print start command being received within a predetermined time period even after a last printing operation, and at a low stand-by level lower than the high stand-by level when the system is in a second stand-by state without the print start command being received even after the predetermined time has passed.

10 Claims, 5 Drawing Sheets

IMAGE FIXING HEATER HAVING STANDBY TEMPERATURE CONTROL

BACKGROUND OF THE INVENTION

1. Field of the Invention

The present invention relates to a method and an apparatus for forming an image by electrophotography, wherein the image is fixed on the recording medium by a heating device, and which permits a new printing job to be started in a relatively short time after the last printing job.

2. Discussion of the Related Art

A recording or printing apparatus adapted to form an image by electrophotography is known, wherein a visible image is fixed on a recording medium under heat generated by an image fixing heating device. In one type of such image forming apparatus, a scanner motor of a scanning unit for generating a latent image is turned off immediately after each printing operation or job, and the temperature of the heating device is held at a stand-by temperature lower than a predetermined image fixing temperature for a predetermined time period after the last printing job. In another type of such apparatus, the scanner motor is kept on, and the temperature of the heating device is held at the image fixing temperature even after the last printing job is completed, so that a new printing job may be started in a short time after the last printing job.

In the former type of electrophotographic image forming apparatus, when a print start command for a new printing job is received within the predetermined time period after the last printing job, the new printing job cannot be started until the scanner motor is turned on and accelerated to the predetermined nominal operating speed and until the temperature of the heating device is raised to the image fixing temperature. Accordingly, it takes a relatively long time for the new printing job to be started after the last printing job.

In the latter type of apparatus, the temperature of the heating device may be held at the relatively high image fixing temperature for a long time without a printing operation being performed after the last printing job. This means a waste of electric power in maintaining the heating device at the relatively high image fixing temperature, due to a long stand-by time without a print start command being received after the last printing job. Further, this arrangement tends to raise the temperature within the apparatus to a high level, whereby the apparatus may be adversely influenced by the heat. For instance, a laser output of the scanner unit may be undesirably lowered due to the heat generated by the heating device while the apparatus is in a stand-by state without a print start command being received.

SUMMARY OF THE INVENTION

It is therefore a first object of the present invention to provide a method of forming an image by electrophotography, which permits a new printing job to be started in a relatively short time after the last printing job, with the temperature of an image fixing heating device being held at a level lower than the nominal image fixing temperature during a predetermined time period after the last printing job, so as to minimize electric power consumption by the heating device, while protecting a scanner unit and other components of the apparatus against adverse influences of the heat generated by the heating device.

It is a second object of this invention to provide an electrophotographic image forming apparatus which is suitable for practicing the method described above.

The first object indicated above may be achieved according to a first aspect of this invention, which provides a method of forming an image by an electrophotographic image forming apparatus, comprising the steps of: (a) generating a visible image on a recording medium in response to a print start command; (b) applying heat to the recording medium to fix the visible image on the recording medium; (c) detecting a temperature adjacent to a heating device for generating the heat; (d) measuring a predetermined time which has passed after a last image forming operation which includes the above steps of generating the visible image and apply heat to the recording medium; and (e) controlling the heating device such that the temperature is held at an image fixing level when the visible image is generated and fixed by the heat generated by the heating device, at a high stand-by temperature lower than the image fixing temperature when the apparatus is in a first stand-by state without the print start command being received within the predetermined time, and at a low stand-by level lower than the high stand-by level when the apparatus is in a second stand-by state without the print start command being received after the above-indicated predetermined time has passed.

The second object indicated above may be achieved according to a second aspect of the invention, which provides an electrophotographic image forming apparatus comprising: (i) an image forming device for generating a visible image on a recording medium in response to a print start command; (ii) a heating device for generating heat applied to the recording medium for fixing the visible image on the recording medium; (iii) a temperature detector for detecting a temperature adjacent to the heating device; (iv) a time measuring device for measuring a predetermined time which has passed after a last image forming operation by the image forming device and heating device; and (v) a controller for controlling the heating device such that the temperature is held at an image fixing level when the image forming device is in operation in response to the print start command, at a high stand-by level lower than the image fixing level when the apparatus is in a first stand-by state without the print start command being received within the predetermined time, and at a low level higher than the high stand-by level when the apparatus is in a second stand-by state without the print start command being received after the predetermined time has passed.

In the electrophotographic image forming apparatus of the present invention constructed as described above to practice the method described above, the visible image generated by the image forming device is fixed on the recording medium by the heat generated by the heating device while the temperature of the heating device is held at the image fixing level, namely, nominal operating temperature of the heating device. During the predetermined time after each image forming operation of the image forming device in response to a print start command, the temperature of the heating device is controlled to be held at the high stand-by level which is lower than the image fixing temperature. As long as no print start command is received during the following period, the temperature of the heating device is controlled to be held at the low stand-by level which is lower than the high stand-by level.

Since the high stand-by level is higher than the low stand-by level which is equivalent to the conventionally used relatively low stand-by temperature, the time required for a new printing job to be started after the last printing job can be significantly reduced. Further, since the high stand-by level is lower than the relatively high nominal image fixing temperature, the amount of electric power required for the heating device during the predetermined time period after the last printing jog can be made comparatively small, and the apparatus can be protected against adverse influences of the heat generated by the heating device during the predetermined first stand-by period following the last printing job.

The controller may be adapted to compare the output of the temperature detector with respective reference values stored in suitable memory, to thereby determine whether the temperature of the heating is higher or lower than the image fixing level and the high and low stand-by levels, for controlling the heating device as explained above.

The controller may comprise a memory for storing a main control routine for controlling an operation of the apparatus. The main control routine may be formulated to control the heating device so as to hold the temperature at the low stand-by level, immediately after the apparatus is turned on and before a first print start command is received, and while the apparatus is in the second stand-by state without the print start command being received even after the predetermined time has passed after the last image forming operation. The main control routine may include a print control sub-routine executed each time the print start command is received. The print control sub-routine may be formulated to control the heating device so as to hold the temperature at the image fixing level as long as the image forming device is in operation in response to the print start command.

The apparatus may further comprise a scanning device for generating a latent image according to print data and in response to the print start command, so that the image forming device generates the visible image on the basis of the latent image. Where the print control sub-routine as described above is provided, this sub-routine may be formulated to start an operation of the image forming device after an operating speed of the scanning device is raised to a predetermined level after the temperature of the heating device is raised to the image fixing level.

The main control routine may further include a post-printing control routine executed after the print control sub-routine is executed. The post-printing control sub-routine may be formulated to control the heating device so as to hold the temperature at the high stand-by level while the apparatus is in the first stand-by state without the print start command being received within said predetermined time after the print control sub-routine is terminated.

The image forming device nay use a photosensitive drum on which the visible image is produced, and an image transfer device for transferring the visible image from the photosensitive drum onto the recording medium before the visible image is fixed by the heating device.

The heating device may comprise a heating roller incorporating a heat generator, so that the recording medium is fed in rolling contact with the heating roller for fixing the visible image on the recording medium.

BRIEF DESCRIPTION OF THE DRAWINGS

The above and other objects, features and advantages of this invention will be better understood by reading the following detailed description of a presently preferred embodiment of the invention, when considered in connection with the accompanying drawings, in which.

DETAILED DESCRIPTION OF THE PREFERRED EMBODIMENT

Figure 1:
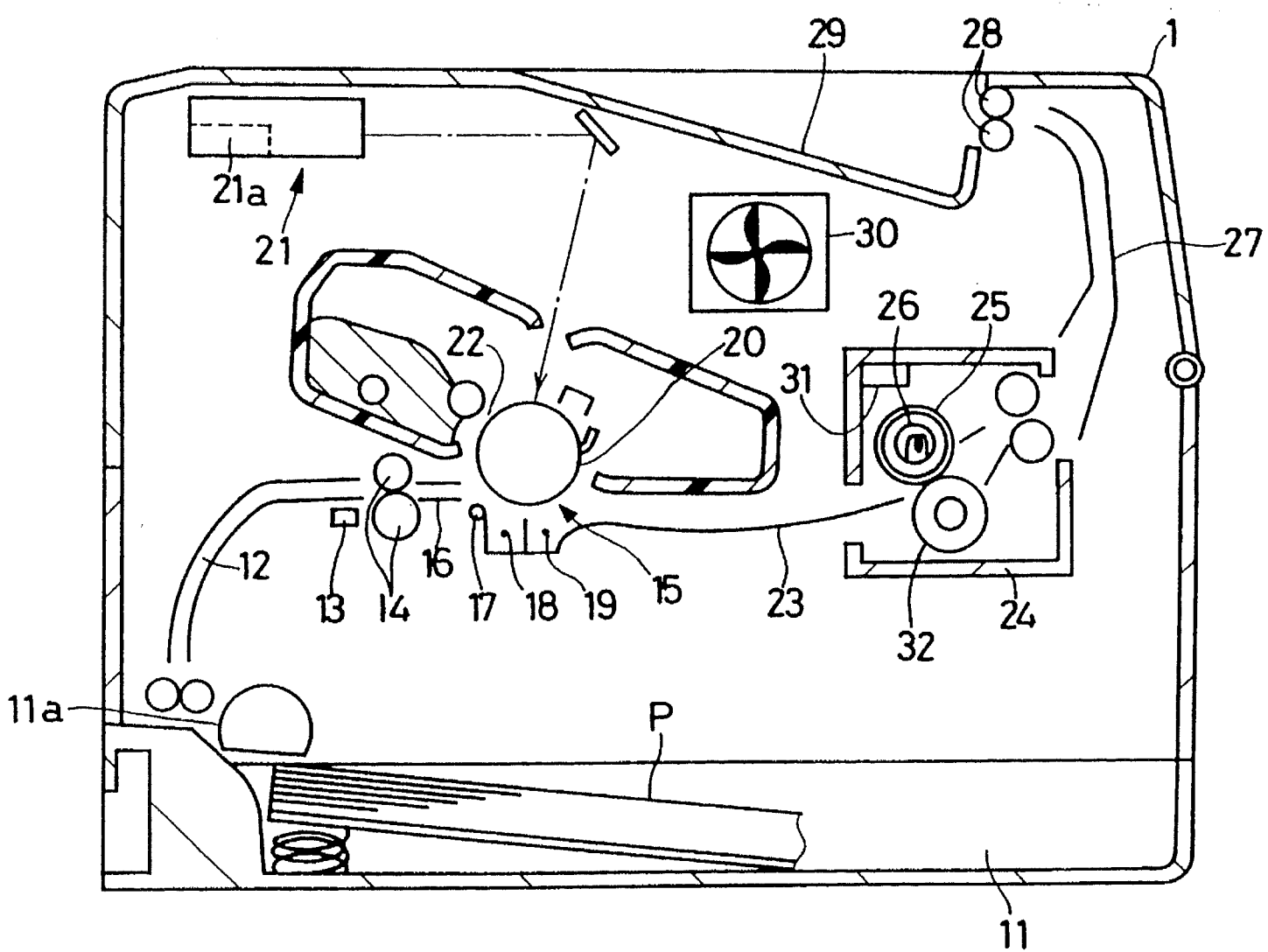
FIG. 1 is a schematic elevational view in cross section of an electrophotographic image forming apparatus in the form of a laser printer constructed according to one embodiment of the present invention.
Figure 2:
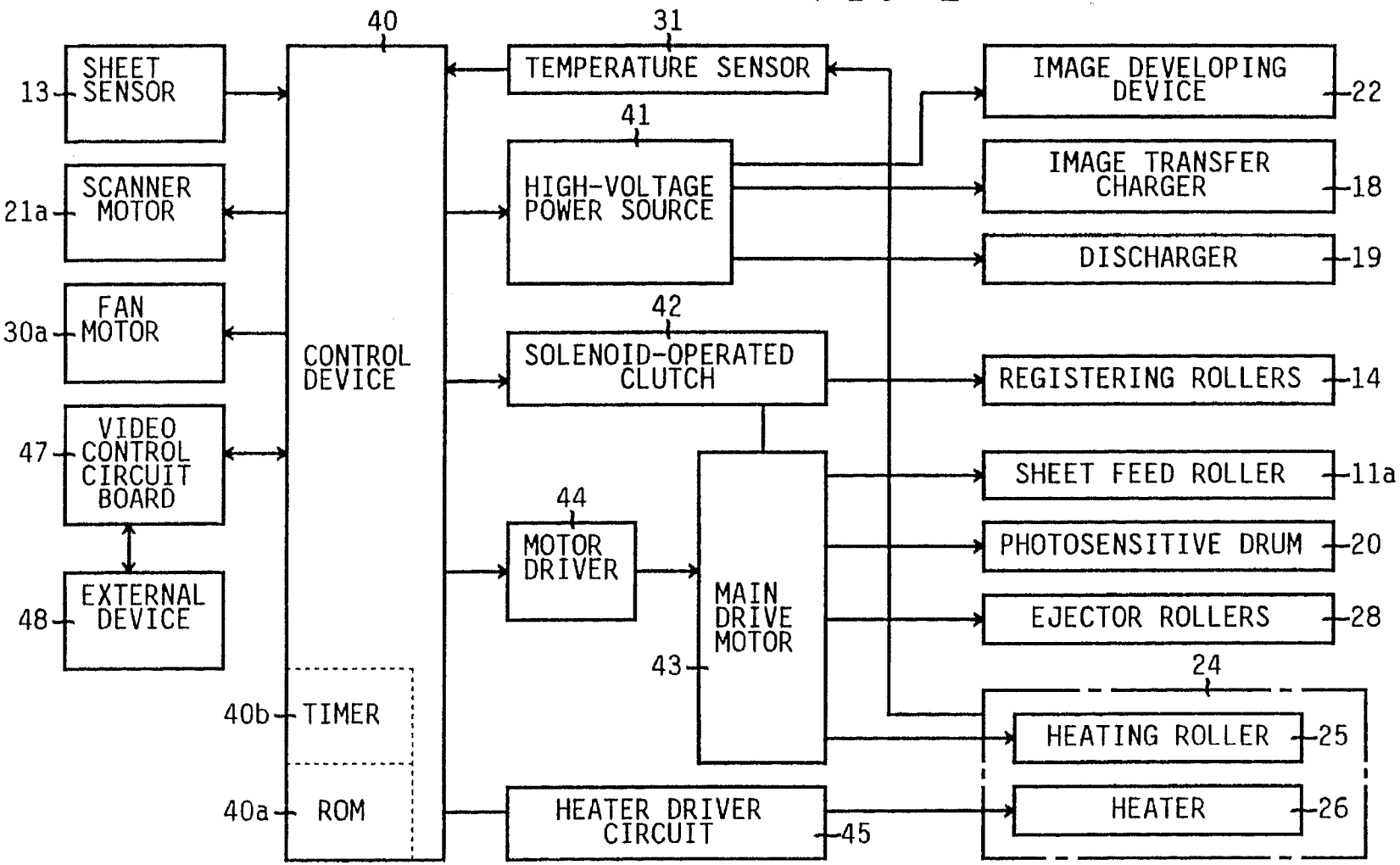
FIG. 2 is a block diagram illustrating an electric control system of the laser printer of FIG. 1.

Referring first to FIGS. 1 and 2, there will be described a laser printer as one embodiment of an electrophotographic image forming apparatus of the present invention.

The laser printer, which is schematically shown in FIG. 1, is equipped with a paper supply 11 disposed in a lower section of a body 1. The paper supply 11 includes a sheet feed roller 11*a* for feeding sheets of paper P toward an image forming assembly indicated generally at 15. The body 15 also houses a first sheet guide 12, a sheet sensor 13, and a pair of registering rollers 14, which are arranged downstream of the paper supply 11, in the order of description.

The paper sheet P delivered from the paper supply 11 by means of the feed roller 11*a* is fed to the registering rollers 14 while it is guided by the first sheet guide 13. The sheet sensor 13 is provided to detect a passage of the sheet P toward the registering rollers 14, so that the registering rollers 14 are rotated a predetermined time after the passage of the sheet P is detected by the sheet sensor 13. The registering rollers 14 are adapted to register the sheet P, so as to remove a skew of the sheet P, if any, while the sheet P is in contact with the rollers 14.

A second sheet guide 16 and a guide roller 17 are disposed downstream of the registering rollers 14, so that the sheet P fed by the rotating registering rollers 14 is guided by the guide 16 and roller 17, and is thereby brought into contact with a photosensitive (photoconductive) drum 20 of the image forming assembly 15. The guide roller 17 is located adjacent to the circumference of the drum 20 so that a visible image formed on the surface of the drum 20 is transferred onto a surface of the sheet P while the sheet P is pressed by the guide roller 17 against the surface of the drum 20.

The image forming assembly 15 is disposed in upper left and central sections of the body 1. The image forming assembly 15, which includes the photosensitive drum 20 as indicated above, also includes a scanner unit 21, an image developing device 22, an image transfer charger 18, and a discharger 19. The scanner unit 21 is located in the upper left corner of the body 1, and is adapted to imagewise expose the surface of the drum 20 so as to form an electrostatic latent image corresponding to an image to be reproduced, as well known in the art. The scanner unit 21 includes a scanner motor 21*a* for driving a polygon mirror for sweeping a laser beam which has been modulated on the basis of print data representative of an image to be reproduced. The latent image consists of electrostatically charged areas of the surface of the drum 20. The image developing device 22 is provided to apply a powdered toner to the electrostatically charged surface areas of the drum 20, for thereby forming a visible image which consists of the toner. The image transfer charger 18 is provided to electrostatically charge the sheet P so that the visible toner image is transferred from the surface of the drum 20 onto the recording surface of the sheet P. The discharger 19 is provided to electrostatically discharge the sheet P so that the sheet P is separated from the surface of the drum 20. Thus, the visible toner image is transferred from the drum 20 to the sheet P while the sheet P is passed between the drum 20 and the charger and discharger 18, 19.

Below and downstream of the image forming assembly 15, there are disposed a third sheet guide 23 and an image fixing heating device 24. The sheet P fed from the image forming assembly 15 is fed into the heating device 24 while the sheet P is guided by the third sheet guide 23. A fourth sheet guide 27 and a pair of ejector rollers 28 are disposed downstream of the image fixing heating device 24. The sheet P leaving the heating device 24 is fed to the ejector rollers 28 while the sheet P is guided by the fourth sheet guide 27. The ejector rollers 28 are adapted to deliver the sheet P onto a tray 29 provided in an upper section on the body 1.

The image fixing heating device 24 includes a heating roller 25 incorporating a heater 26 in the form of a halogen lamp. The heating roller 25 cooperates with a pressing roller 32 to define a pressure nip therebetween, so that the sheet P is fed through the pressure nip. The heating roller 25 is heated by energization of the heater 26. The heating device 24 further includes a temperature sensor 31 to detect the temperature within the heating device 24, more specifically, the temperature adjacent to the heating roller 25.

Near the heating device 24, there is disposed a cooling fan device 30 for discharging hot air from the inside of the body 1 into the surrounding atmosphere, that is, for cooling the interior of the body 1 so as to protect the scanner unit 21 and the other components of the image forming assembly 15 against abnormality due to an excessive rise of the temperature within the body 1.

Referring next to the block diagram of FIG. 2, an electric control system of the laser printer will be described.

The control system includes a control device 40, which is constituted by a microcomputer incorporating a central processing unit, a read-only memory 40*a*, a random-access memory, a timer 40*b*, an A/D converter, and a bus connecting those components. The random-access memory 40*a* stores various control programs such as a main control routine illustrated in the flow chart of FIG. 3, and various sorts of data such as data representative of a first, a second and a third reference voltage Vr1, Vr2 and Vr3. The timer 40*b* is adapted to measure the time each printing operation or job on the recording medium is completed.

The reference voltages Vr1, Vr2 and Vr3 correspond to predetermined temperature levels T1, T2 and T3, respectively. As described below in detail, the heater 26 is controlled so that the temperature of the heating roller 25 is kept at the image fixing level T3 when the laser printer is in a printing operation, at the high stand-by level T2 when the laser printer is in a first stand-by state with no print start command being received within a predetermined time duration after the last printing job, and at the low stand-by level T1 when the laser printer is in a second stand-by state with no print start command being received during the predetermined time duration after the last printing job. As explained below, an output voltage V of the temperature sensor 31 is compared with these reference voltages Vr1, Vr2 and Vr3 to determine whether the temperature of the heating roller 25 is higher or lower than the low and high stand-by levels T1, T2 and the image fixing levels T3. The high stand-by level T2 is lower than the image fixing level T3, and the low stand-by level T1 is lower than the high stand-by level T2.

To the control device 40, there are connected the above-described scanner unit 21, sheet sensor 13, cooling fan device 30 and temperature sensor 31, and a high-voltage power source, a solenoid-operated clutch 42, a motor driver 44, a heater driver circuit 45 and a video control circuit board 47.

The high-voltage power source 41 is connected to the above-indicated image developing device 22, image transfer charger 18 and discharger 19, and applies different levels of voltage to these devices 22, 18, 19 under the control of the control device 40.

The motor driver 44 is provided for driving a main motor 43, which is operatively connected to the sheet feed roller 11*a*, photosensitive drum 20, ejector rollers 28 and heating roller 25, through power transmission gear trains. The main motor 43 is also connected to the registering rollers 14 through the solenoid-operated clutch 42, which is selectively placed in an engaged position or a released position under the control of the control device 40.

The heater driver circuit 45 is provided to drive the heater 26 (halogen lamp). The control device 40 turns on and off the heater 26 via the driver circuit 45, depending upon the output voltage of the temperature sensor 31.

The sheet sensor 13 feeds a signal to the control device 40 when the sheet P is moved over the sensor 13. The control device 40 energizes the solenoid of the solenoid-operated clutch 42 to place the clutch 42 in the engaged position, for transmitting the rotary motion of the main motor 43 to the registering rollers 14, when a predetermined time has elapsed after the generation of the signal from the sheet sensor 13.

The cooling fan device 30 has a motor 30*a* for rotating a cooling fan. The motor 30*a* is controlled by the control device 40 such that the motor 30*a* is held on to dissipate heat generated by the image fixing heating device 24 when the laser printer is in operation, and held off when the laser printer is in the stand-by state. The temperature sensor 31 applies its output voltage V to the control device, and the voltage V is compared by the control device 40 with the reference voltages Vr1, Vr2, Vr3 described above, so that the heater 26 is turned on and off as a result of the comparison.

The video control circuit board 47 is adapted to generate print data on the basis of character data, printing control data and other data received from an external device 48. The generated print data are fed from the circuit board 47 to the control device 40, together with a PRINT START command, so that the control device 40 controls the scanner unit 21 and other components of the laser printer according to the print data, in response to the PRINT START command which requires a printing job to be started according to the print data.

Referring to the flow chart of FIGS. 3–5, there will next be described an operation of the laser printer constructed as described above. Upon application of power to the laser printer, the printer is initialized, and the control device 40 executes a main control routine as illustrated in the flow chart of FIG. 3.

The main routine is initiated with step S1 to read the output voltage V of the temperature sensor 31. Step S1 is followed by step S2 in which the output voltage V is compared with the first reference voltage Vr1 to determine whether the temperature T adjacent to or within the heating device 24 is equal to or higher than the low stand-by temperature T1. If a negative decision (NO) is obtained in step S2, the control flow goes to step S3 to turn on the heater 26 via the driver circuit 45, to raise the temperature T to the low stand-by level T1. Steps S1–S3 are repeatedly implemented until the temperature T is raised to the low stand-by level T1, that is, until an affirmative decision (YES) is obtained in step S2.

If the affirmative decision (YES) is obtained in step S2, step S4 is implemented to turn off the heater 26. Then, the control flow goes to step S5 to determine whether a PRINT START command is received from the video control circuit board 47. If a negative decision (NO) is obtained in step S5, the control goes to step S8, skipping steps S6 and S7.

Figure 4:
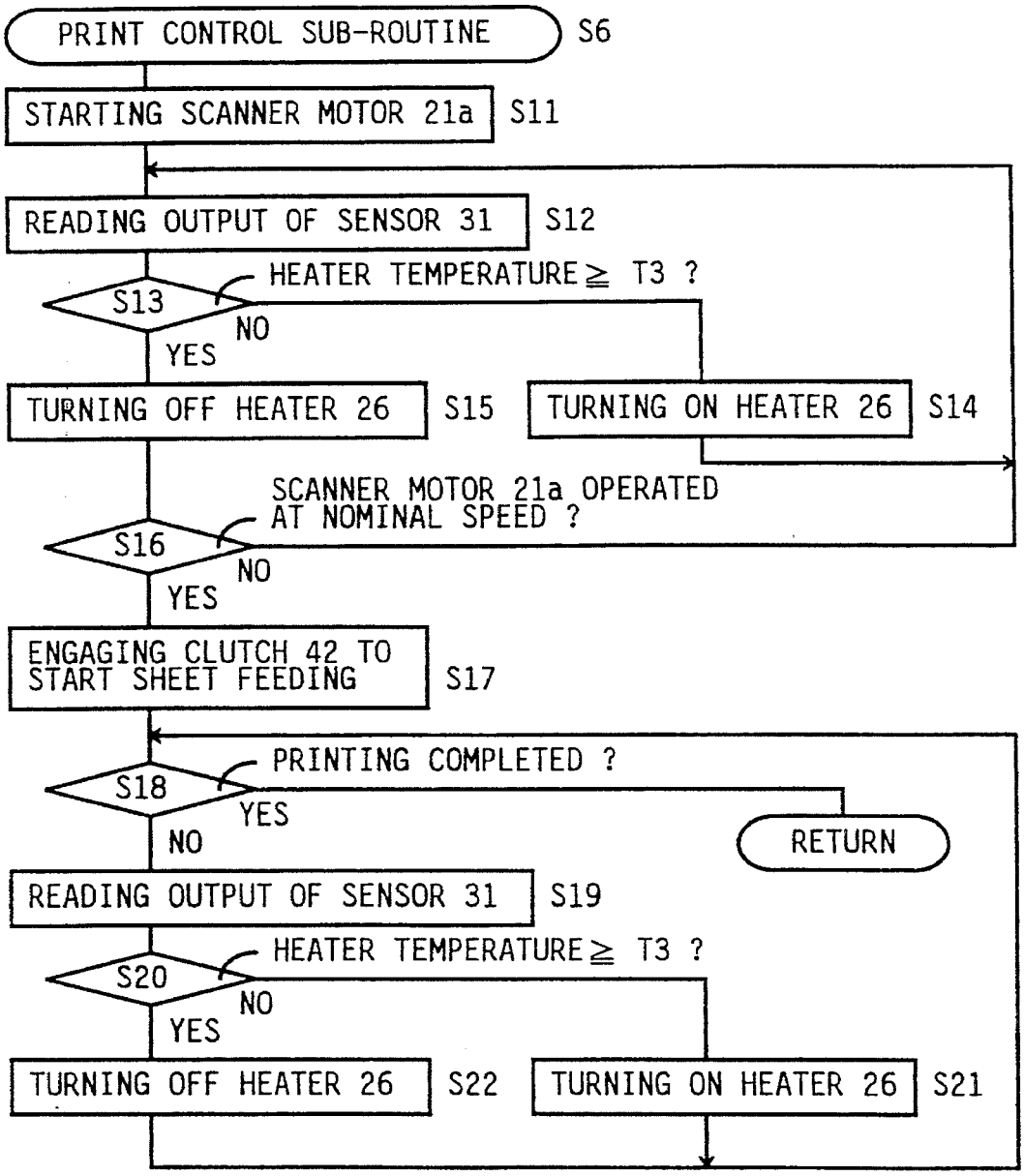
FIG. 4 is a flow chart showing a PRINT CONTROL sub-routine executed in the main routine of FIG. 3 to control a printing operation of the laser printer.

When the PRINT START command is received, step S6 is implemented to execute the PRINT CONTROL sub-routine illustrated in FIG. 4.

Figure 5:
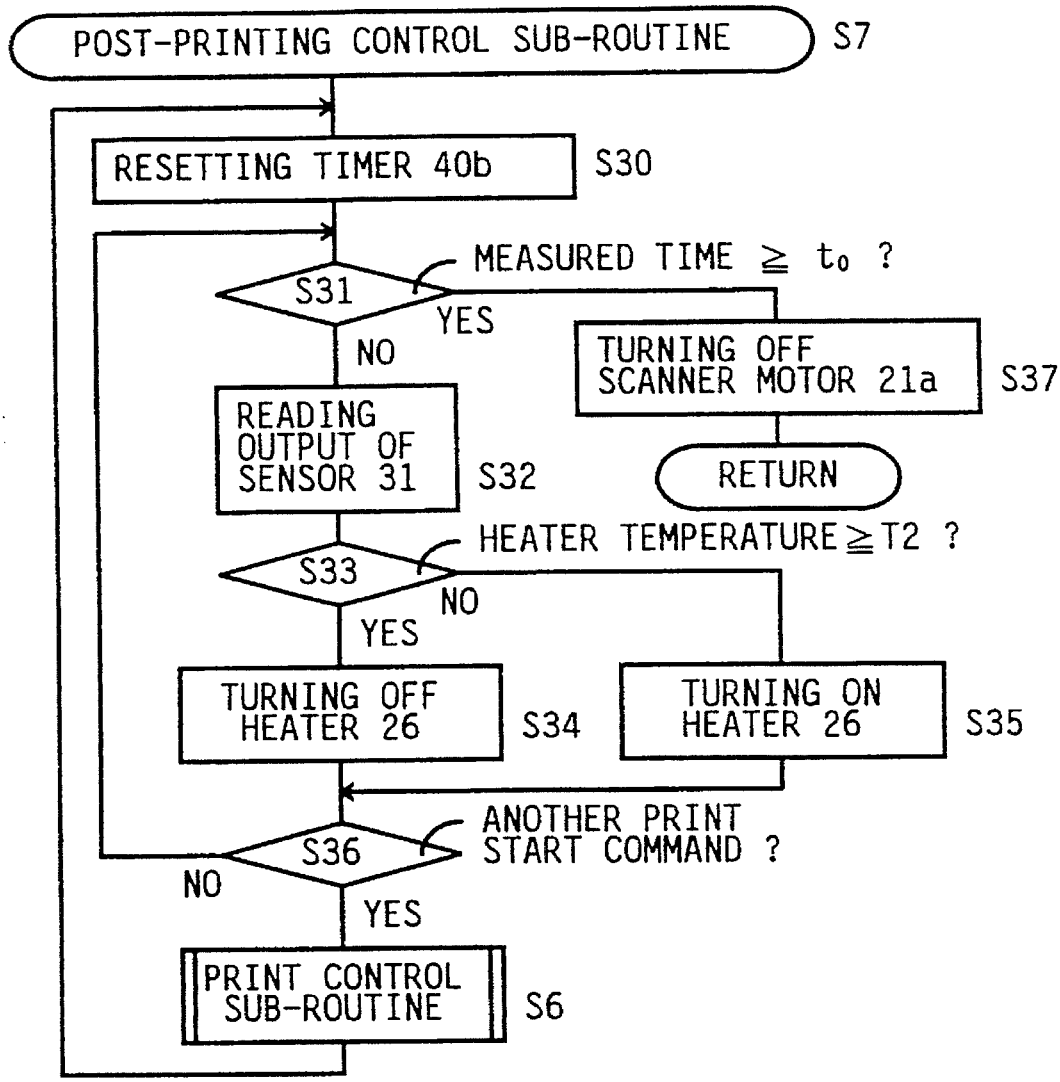
FIG. 5 is a flow chart showing a POST-PRINTING CONTROL sub-routine executed in the main routine of FIG. 3.

The PRINT CONTROL sub-routine in step S6 of the main routine is followed by step S7 in which the POST-PRINTING CONTROL sub-routine illustrated in FIG. 5 is executed. Step S7 is followed by step S8.

Step S8 is provided to determine whether power has been removed from the laser printer. If an affirmative decision (YES) is obtained in step S8, the main routine is terminated, and the laser printer is turned off. If a negative decision (NO) is obtained in step S8, the control goes back to step S1.

Reference is now made to the flow chart of FIG. 4, to describe in detail the PRINT CONTROL sub-routine in step S6 of the main routine.

The PRINT CONTROL sub-routine of FIG. 4 is initiated with step S11 to start the scanner motor 21*a* of the scanner unit 21. Then, step S12 is implemented to read the output voltage V of the temperature sensor 31. Step S12 is followed by step S13 in which the output voltage V of the sensor 31 is compared with the third reference voltage Vr3 to determine whether the temperature T of the heater 26 is equal to or higher than the image fixing temperature T3. If a negative decision (NO) is obtained in step S13, step S14 is implemented to turn on the heater 26. Steps S12–S14 are repeatedly implemented until the temperature T is raised to the predetermined image fixing level T3.

If an affirmative decision (YES) is obtained in step S13, the control flow goes to step S15 to turn on the heater 26. Then, step S16 is implemented to determine whether the operating speed of the scanner motor 21*a* is raised to the predetermined or nominal value. If a negative decision (NO) is obtained, the control flow goes back to step S12. Steps S12–S16 are repeatedly implemented so as to hold the temperature T at the image fixing level T3 until the scanner motor 21*a* is accelerated to the nominal operating speed.

If the scanner motor 21*a* is operated at the nominal speed, that is, if an affirmative decision (YES) is obtained in step S16, the control flow goes to step S17 in which the solenoid-operated clutch 42 is activated or brought to its engaged position for rotating the registering rollers 14 to start feeding the sheets P, whereby visible images formed on the drum 20 are transferred onto the sheets P, and the visible images are fixed on the sheets P by heat generated by the heating device 24.

Step S17 is followed by step S18 to determine whether the printing operation in question is completed. If a negative decision (NO) is obtained in step S18, step S19 is implemented to read the output voltage V of the temperature sensor 31. Step S19 is followed by step S20 to determine again whether the temperature T of the heater 26 is equal to or higher than the predetermined image fixing level T3. If a negative decision (NO) is obtained in step S20, step S21 is implemented to turn on the heater S21. Steps S18–S21 are repeatedly implemented until the temperature T is raised to the image fixing level T3. If an affirmative decision (YES) is obtained in step S20, the control flow goes to step S22 to turn off the heater 26. Steps S18–S22 are repeatedly implemented until the printing operation in question is completed.

As described above, the PRINT CONTROL sub-routine is adapted to: turn on the scanner motor 21*a*; initially control the heating device 26 so as to hold the temperature T at the image fixing level T3; activate the solenoid-operated clutch 42 to start feeding the sheets P after the operating speed of the scanner motor 21*a* is raised to the predetermined value (and after the temperature T is raised to the image fixing level T3); and control the heating device 26 so as to hold the temperature T at the level T3 as long as the printing operation is effected.

There will next be described the POST-PRINTING CONTROL sub-routine, by reference to the flow chart of FIG. 5.

The POST-PRINTING CONTROL sub-routine of FIG. 5 is initiated with step S30 to reset the timer 40*b* of the control device 40, to start measuring the time lapse after the last printing operation or job is completed in the PRINT CONTROL sub-routine. Then, step S31 is implemented to determine whether the time measured by the timer 40*b* is equal to or longer than a preset value $t_o$.

Figure 3:
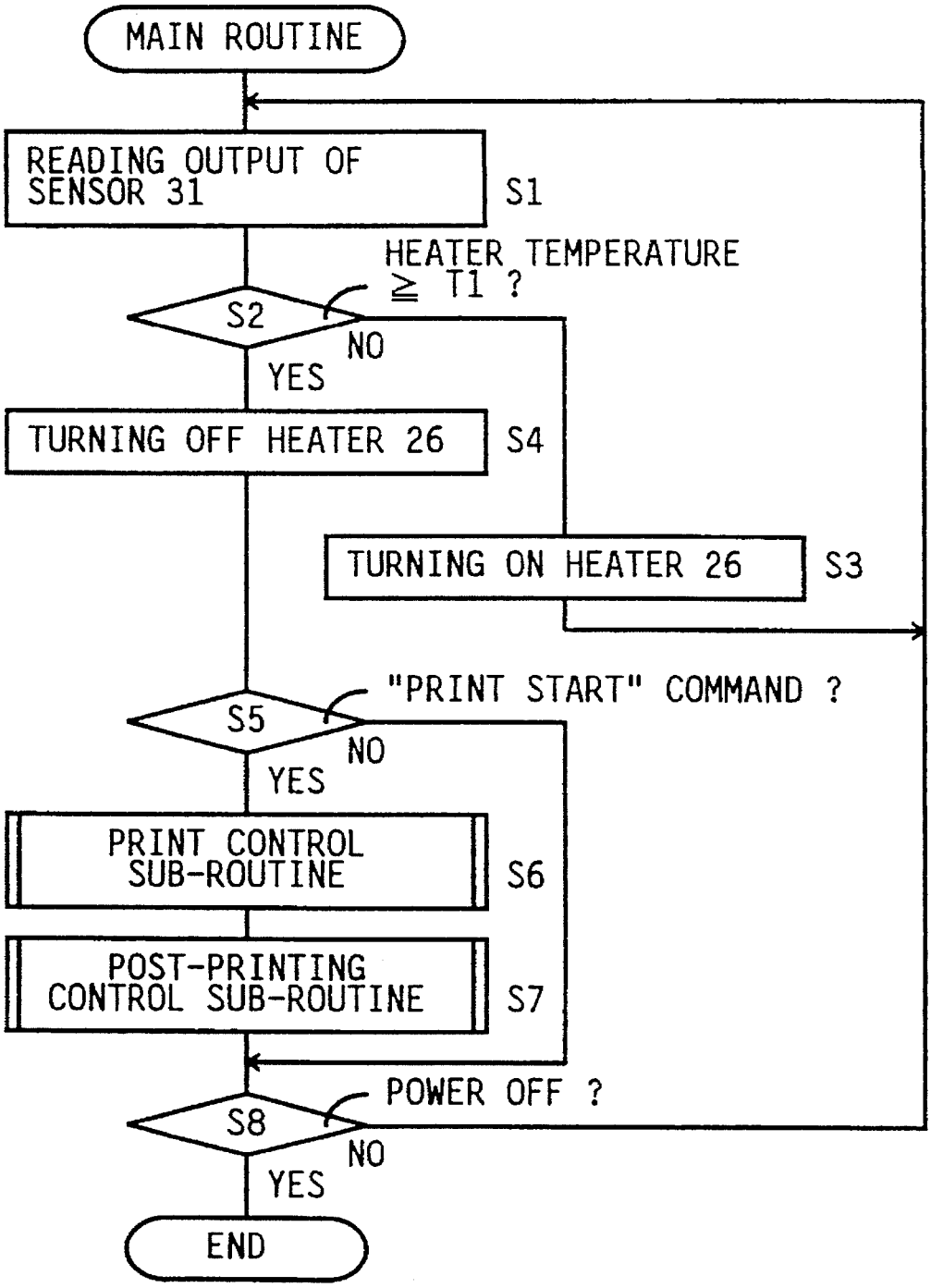
FIG. 3 is a flow chart showing a main control routine executed by the laser printer of FIG. 1.

If an affirmative decision (YES) is obtained in step S31, that is, if the predetermined time has passed after the last printing job, step S37 is implemented to turn off the scanner motor 31*a*, and the control goes back to step S8 of the main routine of FIG. 3.

If a negative decision (NO) is obtained in step S31, that is, if the time which has elapsed after the last printing job is shorter than the predetermined value to, step S32 is implemented to read the output voltage V of the temperature sensor 31. Then, step S33 is implemented to compare the output voltage V with the second reference voltage Vr2, to determine whether the temperature T of the heading device 24 is equal to or higher than the high stand-by level T2. If a negative decision (NO) is obtained in step S33, the control flow goes to step S35 to turn on the heater 26. If an affirmative decision (YES) is obtained in step S33, step S34 is implemented to turn off the heater 26. Then, the control flow goes to step S36 to determine whether a PRINT START command has been received from the video control circuit board 47.

If a negative decision (NO) is obtained in step S36, the control returns to step S31 to determine again whether the predetermined time to has passed after the last printing job. If an affirmative decision (YES) is obtained in step S36, the control flow goes to step S6 to execute the PRINT CONTROL sub-routine again, and then returns to step S30 to start measuring time lapse after the last printing job (performed in the sub-routine of FIG. 4).

It will be understood from the foregoing explanation that the temperature T of the heating device 24 is controlled to be held at the second stand-by temperature T2 higher than the low stand-by temperature T1 and lower than the third or image fixing temperature T3, during a predetermined time period ($t_o$) following the completion of the last printing job or operation. If the PRINT START command is received during that time period, the corresponding printing operation can be commenced in a relatively short time, that is, the PRINT-CONTROL sub-routine of FIG. 4 can be executed without having to raise the temperature T from the relatively low level T1, since the temperature T has already been kept at the high stand-by level T2. Thus, a new printing job can be started in a relatively short time after the last printing job when the PRINT START command for the new printing job is received within the predetermined time period ($t_o$) after the last printing job. Further, since the high stand-by temperature T2 is lower than the image fixing temperature T3, the amount of electric power required for holding the temperature T at the high stand-by temperature T2 is relatively small.

It is also noted that if a PRINT START command is received after the predetermined post-printing time ($t_o$) has passed and the temperature T is lowered to the low stand-by level T1, the temperature T is raised directly to the image fixing level T3, without once controlling the temperature T to the intermediate or high stand-by temperature T2. Thus, the control of the temperature T is simplified and can be effected with high efficiency.

While the present invention has been described above in detail in its presently preferred embodiment, it is to be understood that the invention is not limited to the details of the illustrated embodiment, but may be otherwise embodied.

Although the laser printer has been described as one form of the electrophotographic image forming apparatus, the principle of the present invention is equally applicable to other types of electrophotographic image forming apparatus using an image fixing heating device, such as LED printers, liquid crystal printers, facsimile systems and copying machines.

What is claimed is:

1. A method of forming an image by an electrophotographic image forming apparatus, comprising the steps of:

generating a visible image on a recording medium in response to a print start command;

applying heat to said recording medium to fix said visible image on said recording medium;

detecting a temperature adjacent to a heating device for generating said heat;

measuring a predetermined time which has passed after a last image forming operation which includes said steps of generating a visible image and apply heat to said recording medium; and controlling said heating device such that said temperature is held at an image fixing level when said visible image is generated and fixed by the heat generated by said heating device, at a high stand-by level lower than said image fixing level when the apparatus is in a first stand-by state without said print start command being received within said predetermined time, and at a low stand-by level lower than said high stand-by level when the apparatus is in a second stand-by state without said print start command being received even after said predetermined time has passed, said step of controlling said heating device comprising storing in a memory a main control routine for controlling an operation of the apparatus, said main control routine being formulated to control said heating device so as to hold said temperature at said low stand-by level immediately after the apparatus is turned on and before a first print start command is received, and when the apparatus is in said second stand-by state without the print start command being received even after said predetermined time has passed after said image forming operation.

2. An electrophotographic image forming apparatus comprising:

an image forming device for generating a visible image on a recording medium in response to a print start command;

a heating device for generating heat applied to said recording medium for fixing said visible image on said recording medium;

a temperature detector for detecting a temperature adjacent to said heating device;

a time measuring device for measuring a predetermined time which has passed after a last image forming operation by said image forming device and heating device; and a controller for controlling said heating device such that said temperature is held at an image fixing level when said image forming device is in operation in response to said print start command, at a high stand-by level lower than said image fixing level when the apparatus is in a first stand-by state without said print start command being received within said predetermined time, and at a low stand-by level lower than said high stand-by level when the apparatus is in a second stand-by state without said print start command being received even after said predetermined time has passed, said controller comprising a memory for storing a main control routine for controlling an operation of the apparatus, said main control routine being formulated so as to hold said temperature at said low stand-by level immediately after the apparatus is turned on and before a first print start command is received, and when the apparatus is in said second stand-by state without the print start command being received even after said predetermined time has passed after said last image forming operation.

3. An electrophotographic image forming apparatus according to claim 2, further comprising a memory for storing data representative of said image fixing level and said high and low stand-by levels.

4. An electrophotographic image forming apparatus according to claim 3, wherein said data representative of said image fixing level and said high and low stand-by levels of said temperature consist of respective reference values of an output of said temperature detector.

5. An electrophotographic image forming apparatus according to claim 2, further comprising a comparator for comparing said temperature detected by said temperature detector with said image fixing level and said high and low stand-by levels, said controller controlling said heating device on the basis of an output of said comparator.

6. An electrophotographic image forming apparatus according to claim 2, wherein said main control routine includes a print control sub-routine executed each time said print start command is received, said print control sub-routine being formulated to control said heating device so as to hold said temperature at said image fixing level as long as said image forming device is in operation in response to said print start command.

7. An electrophotographic image forming apparatus according to claim 6, further comprising a scanning device for generating a latent image according to print data and in response to said print start command, said image forming device generating said visible image on the basis of said latent image, and wherein said print control sub-routine is formulated to start an operation of said image forming device after an operating speed of said scanning device is raised to a predetermined level after said temperature is raised to said image fixing level.

8. An electrophotographic image forming apparatus according to claim 6, wherein said main control routine includes a post-printing control sub-routine executed after said print control sub-routine is executed, said post-printing control sub-routine being formulated to control said heating device so as to hold said temperature at said high stand-by level when the apparatus is in said first stand-by state without said print start command being received within said predetermined time after said print control sub-routine is terminated.

9. An electrophotographic image forming apparatus according to claim 2, wherein said image forming device comprises a photosensitive drum on which said visible image is produced, and an image transfer device for transferring said visible image from said photosensitive drum onto said recording medium.

10. An electrophotographic image forming apparatus according to claim 9, wherein said heating device comprises a heating roller incorporating a heat generator, said recording medium being fed in rolling contact with said heating roller for fixing said visible image on said recording medium.

* * * * *